US006096421A

United States Patent [19]

Waggoner et al.

[11] Patent Number: 6,096,421

[45] Date of Patent: Aug. 1, 2000

[54] PLEXIFILAMENTARY STRAND OF BLENDED POLYMERS

[75] Inventors: James Ross Waggoner, Midlothian, Va.; Andrew Paul Rose, White Sulphur Spring, W. Va.; Charles Wesley Starke, Richmond, Va.; Hyunkook Shin, Wilmington, Del.

[73] Assignee: E. I. du Pont de Nemours and Company, Wilmington, Del.

[21] Appl. No.: 09/101,143

[22] PCT Filed: Jan. 9, 1997

[86] PCT No.: PCT/US97/00157

§ 371 Date: Jun. 30, 1998

§ 102(e) Date: Jun. 30, 1998

[87] PCT Pub. No.: WO97/25459

PCT Pub. Date: Jul. 17, 1997

Related U.S. Application Data

[60] Provisional application No. 60/009,739, Jan. 11, 1996.

[51] Int. Cl.[7] ..... D01F 8/00

[52] U.S. Cl. ..... 428/364; 428/373

[58] Field of Search ..... 428/198, 373, 428/364, 357

[56] References Cited

U.S. PATENT DOCUMENTS

| | | | |
|---|---|---|---|
| 3,081,519 | 3/1963 | Blades et al. | 28/81 |
| 3,169,899 | 2/1965 | Steuber | 428/198 |
| 3,227,784 | 1/1966 | Blades et al. | 264/53 |
| 3,227,794 | 1/1966 | Anderson et al. | 264/205 |
| 3,655,498 | 4/1972 | Woodell | 162/172 |
| 3,851,023 | 11/1974 | Brethauer et al. | 264/24 |
| 4,166,091 | 8/1979 | Beebe | 264/205 |
| 4,260,565 | 4/1981 | D'Amico et al. | 264/13 |
| 4,731,407 | 3/1988 | Benim et al. | 524/451 |
| 5,147,586 | 9/1992 | Shin et al. | 264/13 |
| 5,147,712 | 9/1992 | Miyahara et al. | 428/224 |
| 5,192,468 | 3/1993 | Coates et al. | 264/13 |
| 5,371,810 | 12/1994 | Vaidyanathan | 382/48 |
| 5,405,682 | 4/1995 | Shawyer et al. | 428/221 |
| 5,795,651 | 8/1998 | Matsuoka et al. | 428/364 |
| 5,816,700 | 10/1998 | Starke, Sr. et al. | 366/147 |

FOREIGN PATENT DOCUMENTS

| | | | |
|---|---|---|---|
| 0 645 480 A1 | 3/1995 | European Pat. Off. | D01F 8/06 |
| 8-113 819 | of 0000 | Japan | D01D 5/11 |
| 8-113 890 | of 0000 | Japan | D21H 13/16 |
| 8-113 858 | 5/1996 | Japan | D04H 1/42 |
| 8-113 859 | 5/1996 | Japan | D04H 1/42 |
| 970070 | 9/1964 | United Kingdom . | |

OTHER PUBLICATIONS

S. Aslan, P. Laurienzo, M. Malinconico, E. Martuscelli, F. Pota, R. Bianchi, G. Di Dino, and G. Giannotta, "Influence of Spinning Velocity on Mechanical and Structural Behavior of PET/Nylon 6 Fibers", *Journal of Applied Polymer Science,* vol. 55, pp. 57–67 (1995).

*Primary Examiner*—N Edwards

[57] ABSTRACT

The invention is directed to a plexifilamentary fiber having at least three polymeric components.

13 Claims, 7 Drawing Sheets

PLEXIFILAMENTARY STRAND OF BLENDED POLYMERS

This application claims benefit of Provisional Application Ser. No. 60/009,739, filed Jan. 11, 1996.

FIELD OF THE INVENTION

This invention relates to a novel plexifilamentary fiber strand material and more particularly to plexifilamentary film-fibril strands that are flash-spun from mixtures of fiber forming polymers.

BACKGROUND OF THE INVENTION

Blades et al., U.S. Pat. No. 3,081,519 (assigned to E.I. du Pont de Nemours and Company "DuPont")) describes a process wherein a solution of fiber-forming polymer in a liquid spin agent is flash-spun into a zone of lower temperature and substantially lower pressure to generate plexifilamentary film-fibril strands. Anderson et al., U.S. Pat. No. 3,227,794 (assigned to DuPont) discloses that plexifilamentary film-fibril strands are best obtained using the process disclosed in Blades et al. when, in a preflashing letdown chamber, the pressure of the polymer and spin agent solution is reduced so as to form a two-phase solution comprised of a fine homogeneous dispersion of a spin agent rich phase in a polymer rich phase. When this two-phase dispersion is released through a spinning orifice into a zone of lower temperature and pressure, the spin agent vaporizes and thereby cools the polymer which in turn forms the plexifilamentary strands.

The term "plexifilamentary strand", as used herein, means a strand which is characterized as a three-dimensional integral network of a multitude of thin, ribbon-like, film-fibril elements of random length and with a mean film thickness of less than about 4 microns and a median fiber width of less than about 25 microns, that are generally coextensively aligned with the longitudinal axis of the strand. In plexifilamentary strands, the film-fibril elements intermittently unite and separate at irregular intervals in various places throughout the length, width and thickness of the strand to form the three-dimensional network.

Anderson et al. discloses that successful flash-spinning of plexifilamentary strands according to the process of Blades et al. requires precise control of process parameters such as pressure, temperature and the ratio of polymer to spin agent. Solution flash-spinning of polymers according to the process of Blades et al. and Anderson et al. is restricted to those polymers for which there exists a compatible spin agent that: (1) is a non-solvent to the polymer below the spin agent's normal boiling point; (2) forms a solution with the polymer at high pressure; (3) forms a desired two-phase dispersion with the polymer when pressure is reduced slightly in a letdown chamber; and (4) flash vaporizes when released from the letdown chamber into a zone of substantially lower pressure. Solution flash-spinning his rarely been used to spin polymer blends because multiple polymers generally do not spin well from a single spin agent and under a single set of processing conditions.

European Patent Publication 645480 filed by Unitika Ltd. discloses a plexifilamentary fiber structure that is flash-spun from a solution of polyolefin and polyester polymers dissolved in methylene chloride. The polyolefins disclosed include polyethylene and polypropylene polymers and copolymers. The polyesters disclosed include polyethylene terephthalate and polybutylene terephthalate. The Unitika patent discloses that the mixing ratio (by weight) of the polyolefin to the polyester is from 5/95 to 95/5.

British Patent Specification 970,070 (assigned to DuPont) discloses nonwoven sheets made from fibers that were flash-spun from a blend of polyethylene and a minor amount of another polymer such as polyamide, polyvinyl chloride, polystyrene or polyurethane.

It has been found that quality plexifilamentary fiber strands can be spun from a finely divided dispersion of polymer in a spin agent without first forming a solution of the polymer and the spin agent. A process for flash-spinning of polymers from a mechanically generated dispersion of polymer, $CO_2$ and water was disclosed in Coates et al., U.S. Pat. No. 5,192,468 (assigned to DuPont), which is hereby incorporated by reference. Among the polymers spun in Coates et al. are polyethylene blended with an ethylene vinyl alcohol copolymer, and polypropylene blended with an ethylene vinyl alcohol copolymer.

Blending incompatible polymers into a single fiber has historically led to some deterioration of properties, especially in the property of ultimate fiber strength. For example, recent work in melt spinning blends of polyethylene terepthalate (PET) and nylon 6 has shown that the addition of 5% of nylon 6 to PET results in a 5% loss in tenacity and break elongation (Journal of Applied Polymer Science, Vol. 55, pages 57–67 (1995)). Thus, it would not be expected that flash-spun blends of three or more incompatible polymers could actually improve fiber properties, including fiber tenacity.

It has now been discovered that blends of three or more polymers can be flash-spun, either from a mechanically generated dispersion of polymer, super critical carbon dioxide and water, or from a solution of a polymer in a solvent. It has also been found that the plexifilamentary strands spun from many such polymer blends have improved properties when compared to fibers flash-spun from just one or two of the polymers. The fiber strands of the invention will be useful in a variety of end uses, including filters, absorbent wipes, thermal and acoustical insulation materials, and garments.

SUMMARY OF THE INVENTION

There is provided by this invention a plexifilamentary fiber strand material comprising a three dimensional integral plexus of fibrous elements substantially aligned with the strand axis, the fibrous elements each comprised of first, second and third synthetic, organic polymers, each of the polymers comprising between 2% and 96% by weight of said fibrous elements. Preferably, the second and third polymers are each dispersed throughout the first polymer, and each of the first, second and third polymers consists essentially of a polymer that in its molten state is immiscible in the molten state of either of the other two of the polymers. It is further preferred that the second and third polymers of the plexifilamentary fiber strand material be uniformly dispersed throughout the first polymer in the form of discrete particles or as a bicontinuous network. One of the polymers in the fibers preferably consists of polyester and the second and third polymers of the fiber each preferably consist of a polymer selected from the group of polyethylene polymers and copolymers, polypropylene polymers and copolymers, grafted and ungrafted copolymers of ethylene and vinyl alcohol, copolymers of methacrylic acid, polyester elastomer copolymers, nylon polymers and copolymers, and polyester polymers and copolymers.

BRIEF DESCRIPTION OF THE DRAWINGS

The accompanying drawings, which are incorporated in and constitute a part of this specification, illustrate the presently preferred embodiment of the invention and, together with the description, serve to explain the principles of the invention.

DETAILED DESCRIPTION OF THE PREFERRED EMBODIMENT

Figure 1:
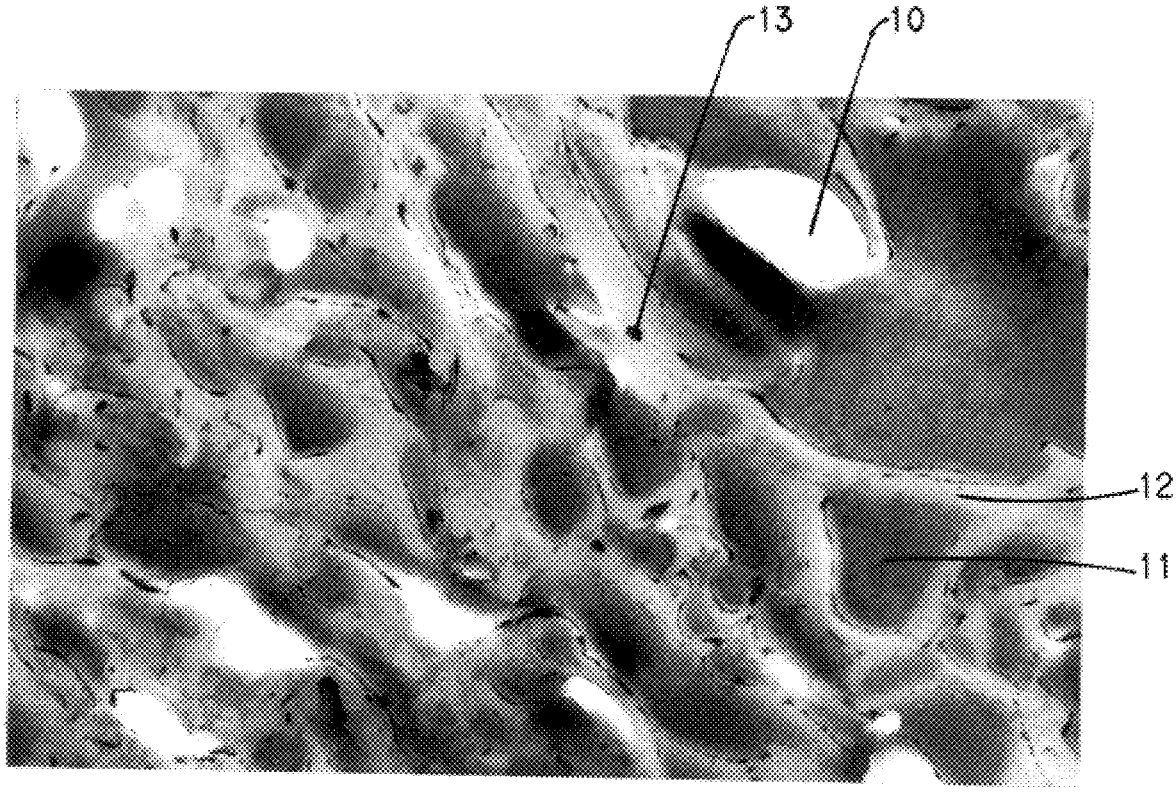
FIG. 1 is a transmission electron micrograph of a section of the plexifilamentary strand described in Example 18, magnified 54,600 times.

Reference will now be made in detail to the presently preferred embodiments of the invention, examples of which are illustrated below. The plexifilamentary strand material of the present invention is comprised of a blend of three or more fiber forming polymers. As can be seen in the following examples, flash-spun blends of three or more polymers can be tailored to selectively combine properties of the various component polymers and to improve upon the properties of the individual components. For example, a plexifilamentary strand can be made from a blend of polyester, polyethylene and polypropylene that enjoys the high melting temperature and ease of processing associated with polyester, the tensile strength associated with polyethylene, and the fiber fineness and softness associated with polypropylene. Indeed, multi-polymer plexifilamentary strands can be flash-spun with many properties superior to the comparable properties in plexifilamentary strands flash-spun from any of the individual polymer components. Plexifilamentary fiber strands can be flash-spun from a combination of three or more polymers to achieve properties that make the strands especially useful for a specific application, such as for thermal and acoustical insulation materials, for garments, for filters, or for absorbent materials. The multiple polymer plexifilamentary strands of the present invention are spun either from a mechanically generated dispersion of polymer, $CO_2$ and water according to the process disclosed in U.S. Pat. No. 5,192,468 to Coates et al., or from a solution of a polymer in a solvent as disclosed in U.S. Pat. No. 3,227,794 to Anderson et al.

The plexifilamentary fibers of the invention may be flash-spun from a dispersion that is mechanically generated in a high pressure batch reactor, as described in Coates et al., or in a high pressure, high shear, continuous mixer. The continuous mixer used in the examples below was a rotary mixer that operated at temperatures up to 300° C. and at pressures up to 41,000 kPa. The mixer had a polymer inlet through which a polymer melt blend was continuously introduced into the mixer. The mixer also had a $CO_2$ inlet through which supercritical $CO_2$ was continuously introduced into the polymer stream entering the mixer before the polymer entered the mixing chamber of the mixer. The polymer and $CO_2$ together were injected into the mixer's mixing chamber where they were thoroughly sheared and mixed by a combination of rotating and fixed cutting blades. The mixer further included an injection port through which water was introduced into the mixing chamber at a point downstream of where the polymer and $CO_2$ were initially mixed in the mixing chamber. The polymer, $CO_2$ and water were further mixed in the mixer by at least one additional set of rotating and fixed cutting blades before the mixture of polymer, $CO_2$ and water was continuously discharged from the mixer's mixing chamber. The discharged mixture passed through a heated transfer line to a 0.5 to 0.9 mm diameter round spin orifice from which the mixture was flash-spun. The residence time of the polymer in the mixer's mixing chamber was generally between 7 and 20 seconds. The mixer used in Examples 1–25 and Comparative Examples 1–10 is more fully described in U.S. patent application Ser. No. 60/005,875, filed Oct. 26, 1995, which issued as U.S. Pat. No. 5,816,700.

Alternatively, certain of the blended polymer plexifilamentary fibers of the invention have been flash-spun from a polymer and solvent solution as generally described in U.S. Pat. No. 3,227,794 to Anderson et al. The apparatus used for solution flash-spinning in the examples below was a laboratory scale batch spinning unit that is briefly described in the examples below and is more fully described in U.S. Pat. No. 5,147,586 to Shin et al. It is anticipated that in commercial applications, certain of the blended polymer plexifilaments of the invention could be solution flash-spun using the apparatus disclosed in U.S. Pat. No. 3,851,023 to Brethauer et al.

A polyester polymer particularly useful in making the plexifilamentary polyester blend strands of the invention is polybutylene terephthalate (4GT polyester). A blend of a low molecular weight 4GT polyester and a higher molecular weight 4GT polyester has been found to be especially useful in the invention. The low molecular weight 4GT polyester improves processability while the higher molecular weight 4GT polyester improves the strength of fibers spun from the mixture. Other polyesters that can be used in making the plexifilamentary strand material of the invention include polyethylene terephthalate (2GT polyester), polypropylene terephthalate (3GT polyester), recycled 2GT and 4GT polyester, polybutylene napthalate, and polyethylene napthalate. Additional polymers useful as components of the polymer blends from which the plexifilamentary strand of the invention is spun include polyethylene, polypropylene, polymethylpentene, ethylene copolymers such as ethylene vinyl acetate (EVA), ethylene mathacrylic acid (EMMA), ethylene methyl acrylate (EMA), ethylene acrylic acid (EAA) and ionomers, polyester elastomer copolymers, nylon, polytetrafluoroethylene copolymers, hydrocarbon rubbers such as ethylene/propylene/hexadiene copolymers, polyacrylonitrile (PAN), polyglucosamine, and combinations thereof. The plexifilamentary strand of blended polymers may also include desired non-polymer additives such as color pigments, flame retardants or activated carbon.

The spinning mixture may optionally contain a surfactant. For example, an ethylene vinyl alcohol copolymer has been found to improve processability of a polymer flash-spun from a mechanically-generated dispersion by decreasing the interfacial tension between the polymer phase and the other phases. Upon flash-spinning the ethylene vinyl copolymer becomes a component in the fiber matrix.

FIGS. 1–6 are transmission electron micrographs of plexifilamentary strands comprised of blends of polymers. The micrographs were obtained using a JEOL 2000FX TEM electron microscope operated at 80 to 120 KV accelerating voltage and recorded on sheet film. The materials shown were vacuum impregnated with a liquid epoxy mixture and cured overnight at 60° C. prior to sectioning. The embedded specimens were sliced by cryoultramicrotomy using diamond knives to produce sections of 90 nm nominal thickness. The sections were stained with either 1% aqueous phosphotungstic acid ("PTA") or ruthenium tetroxide vapor. The samples shown in FIGS. 1, 2, 4 and 6 were each stained with 1% phosphotungstic acid, which darkens nylon and the ethylene vinyl alcohol copolymer. The samples shown in FIGS. 3 and 5 were each stained with ruthenium tetroxide vapor, which darkens polyester. FIGS. 1–6 show how the polymers that comprise the plexifilamentary fiber strands are uniformly and intimately mixed with each other, yet are also discrete from each other.

The plexifilamentary strand shown in FIG. 1 is comprised of 90% polybutylene terepthalate, 9% high density polyethylene, and 1% ethylene vinyl alcohol copolymer, and is described more fully in Example 18. The sample shown in FIG. 1 has been magnified 54,600 times. In this micrograph, the light gray portions 12 are polyethylene and/or polybutylene terepthalate (4GT polyester), the black specs 13 are the ethylene vinyl alcohol copolymer, The dark gray portions 11 are the epoxy that was added for sectioning, and the light portions 10 are holes.

Figure 2:
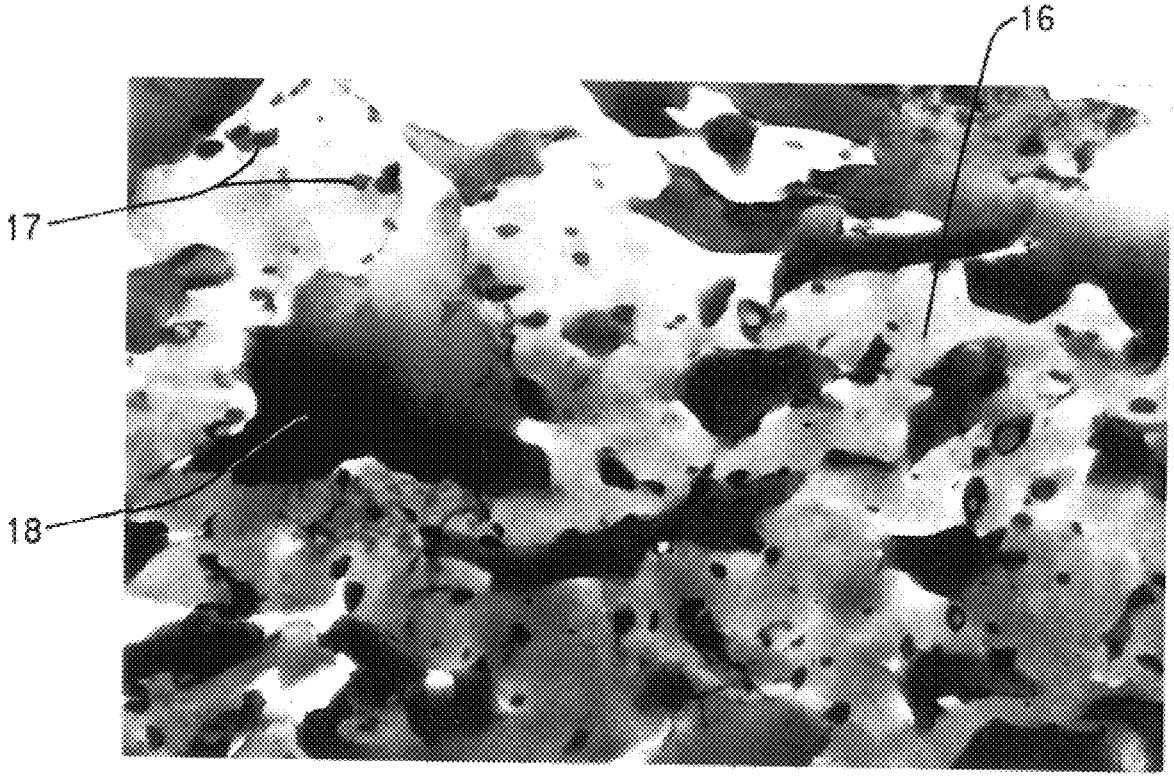
FIG. 2 is a transmission electron micrograph of a section of the plexifilamentary strand described in Comparative Example 6, magnified 26,000 times.

The plexifilamentary strand shown in FIG. 2 is comprised of 90% high density polyethylene and 10% ethylene vinyl alcohol copolymer, and is more fully described in Comparative Example 6. The sample shown in FIG. 2 has been magnified 26,000 times. In this micrograph, the light gray portions 16 are polyethylene, the black specs 17 are the ethylene vinyl alcohol copolymer, and the darker gray portions 18 are the epoxy that was added for sectioning.

Figure 3:
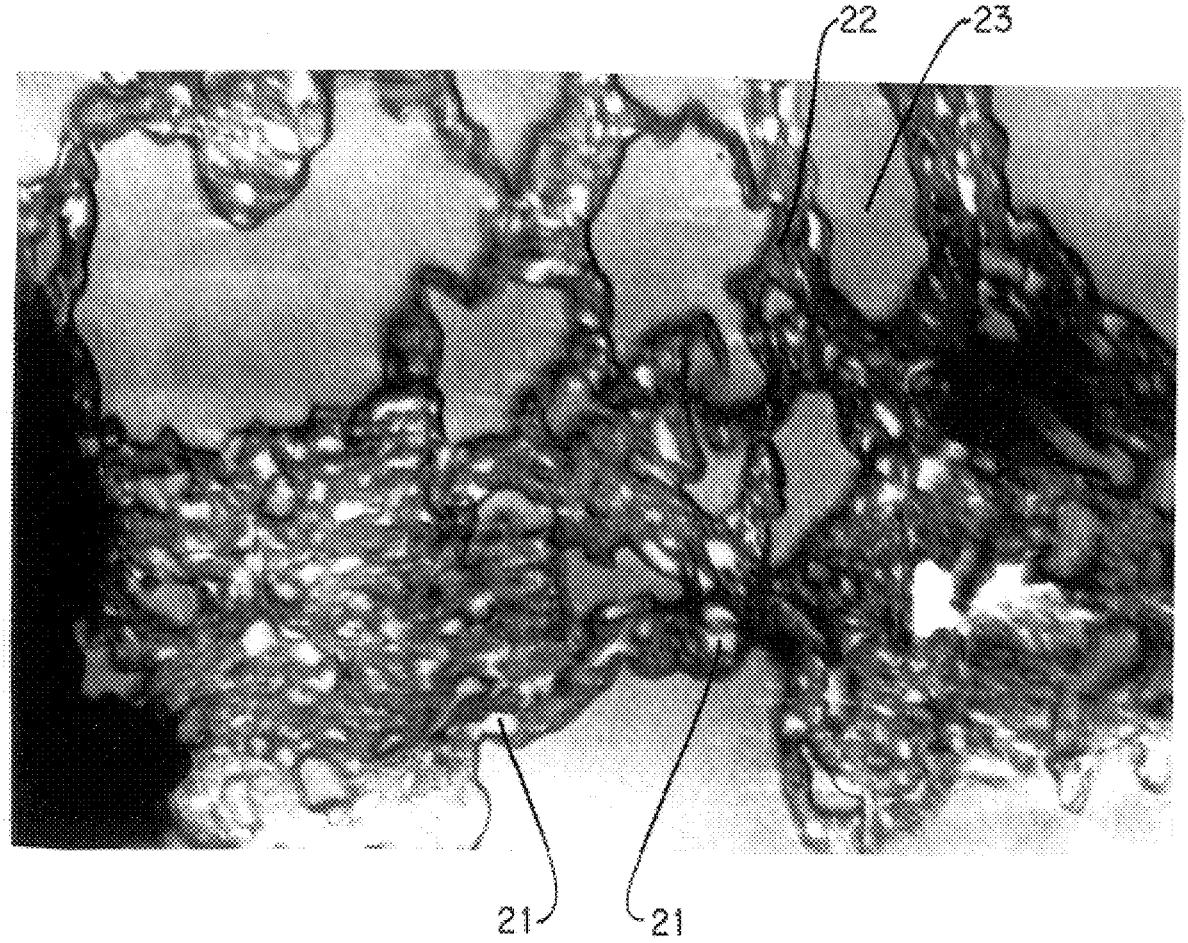
FIG. 3 is a transmission electron micrograph of a section of the plexifilamentary strand described in Example 6, magnified 33,800 times.
Figure 4:
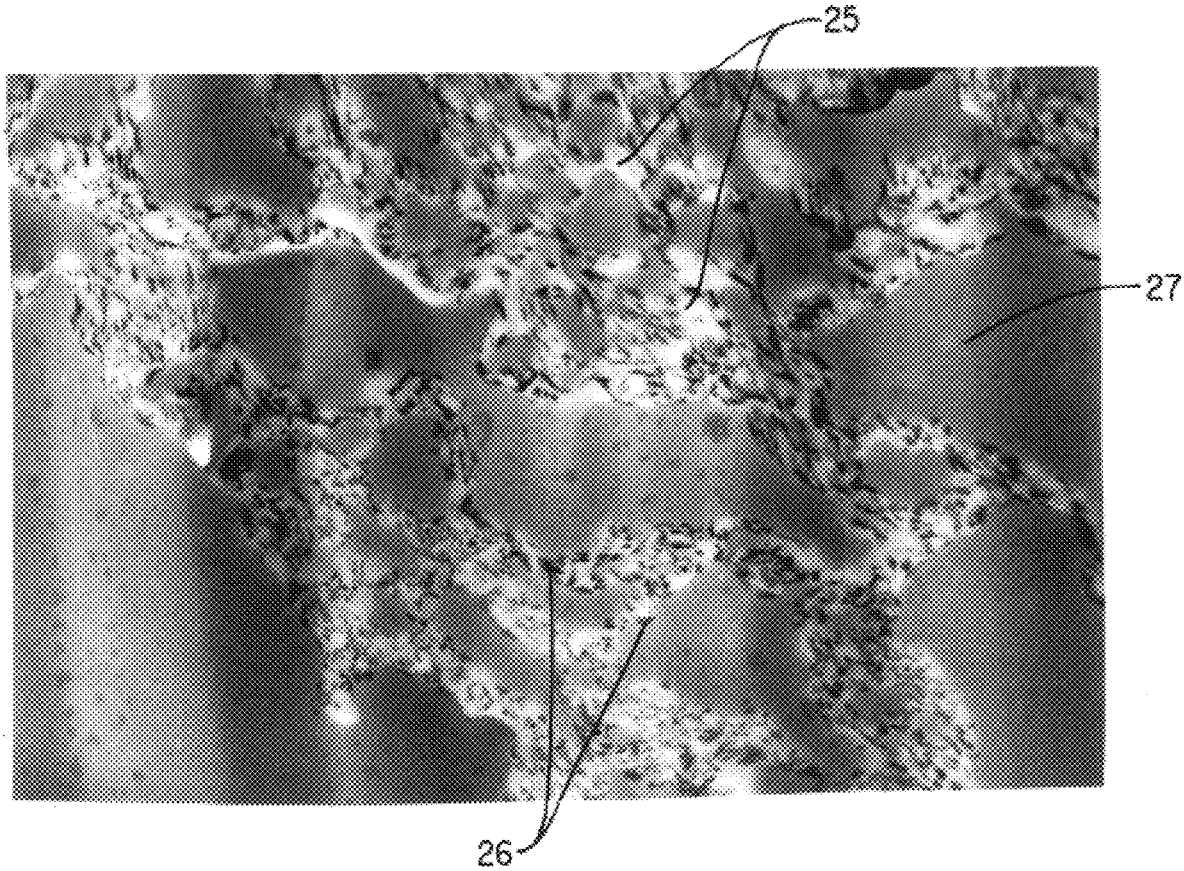
FIG. 4 is a transmission electron micrograph of a section of the plexifilamentary strand described in Example 6, magnified 33,800 times.

The plexifilamentary strand shown in both FIG. 3 and 4 is comprised of 63% polybutylene terepthalate, 12% polyester elastomer block copolymer, 16% high density polyethylene, 8% polypropylene and 1% ethylene vinyl alcohol copolymer, and is described more fully in Example 6. The samples shown in FIGS. 3 and 4 have each been magnified 33,800 times. The sample shown in FIG. 3 was stained with ruthenium tetroxide vapor, to highlight the polyester while the sample shown in FIG. 4 was stained with 1% phosphotungstic acid to highlight the ethylene vinyl alcohol. In the micrograph of FIG. 3, the dark portions 22 are the polybutylene terepthalate (4GT polyester) and the polyester elastomer, the small light colored portions 21 are the polyolefins, the light gray portions 23 are the epoxy that was added for sectioning. In the micrograph of FIG. 4, the light portions 25 are the 4GT polyester and polyolefin, the dark specs 26 are the polyester elastomer and the ethylene vinyl alcohol copolymer, and the light gray portions 27 are the epoxy that was added for sectioning.

Figure 5:
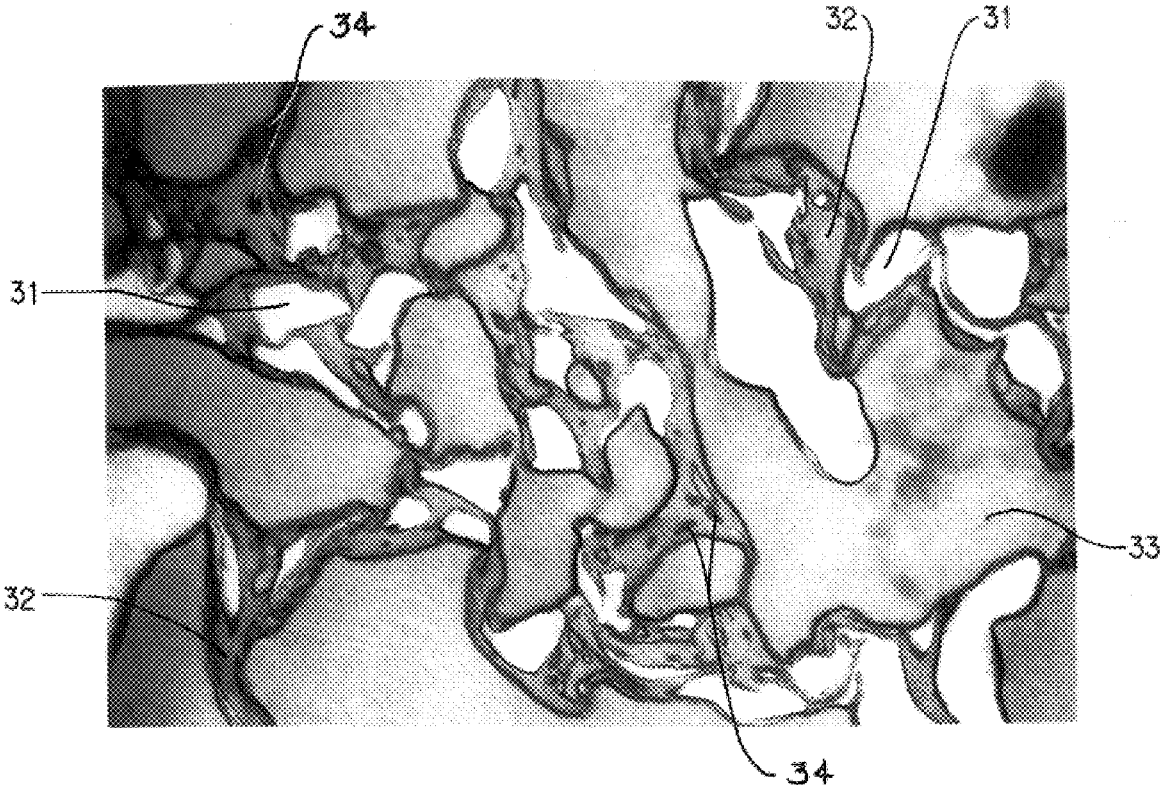
FIG. 5 is a transmission electron micrograph of a section of the plexifilamentary strand described in Example 2, magnified 65,000 times.
Figure 6:
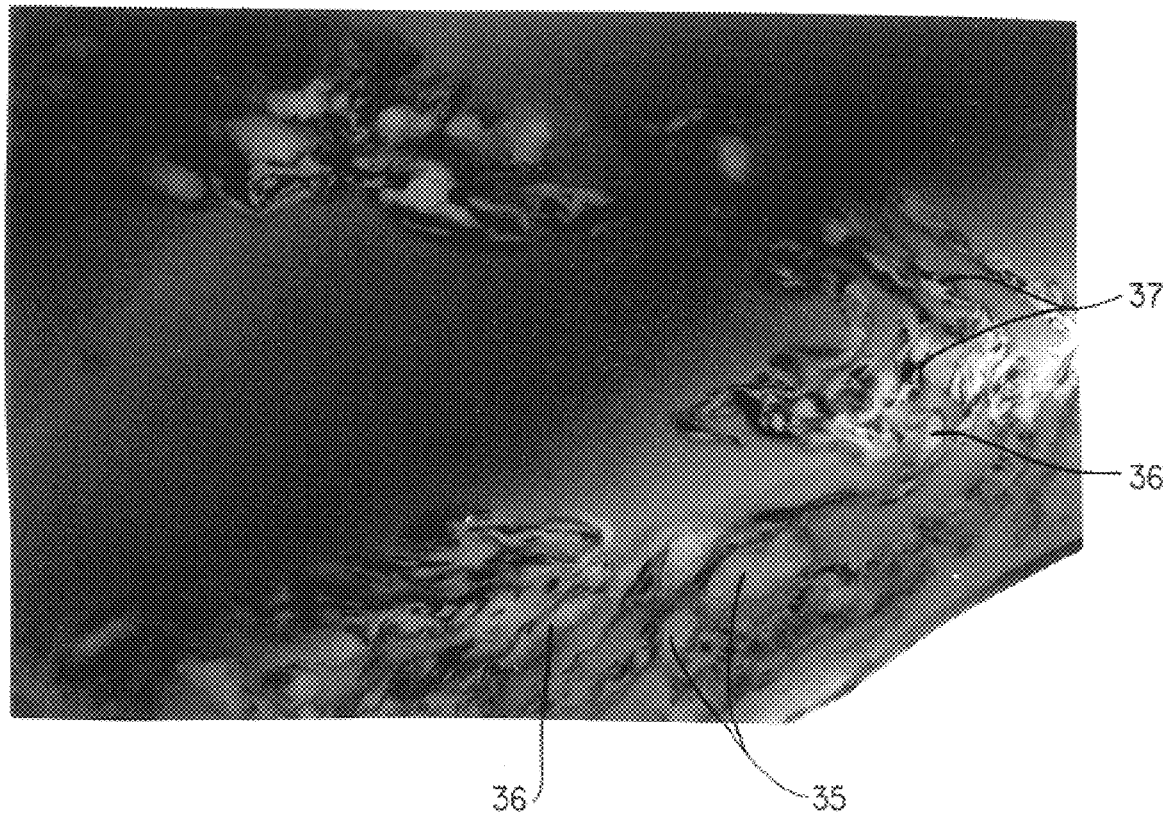
FIG. 6 is a transmission electron micrograph of a section of the plexifilamentary strand described in Example 18, magnified 22,100 times.

The plexifilamentary strand shown in FIG. 5 and 6 is comprised of 45% polybutylene terepthalate, 13% polyester elastomer block copolymer, 19% high density polyethylene, 19% polypropylene, 1% ethylene vinyl alcohol copolymer, and 3% Nylon 6,6, and is described more fully in Example 2. The sample shown in FIG. 5 has been magnified 65,000 times while the sample shown in FIG. 6 has been magnified 22,100 times. The sample shown in FIG. 5 was stained with ruthenium tetroxide vapor to highlight the polyester, while the sample shown in FIG. 6 was stained with 1% phosphotungstic acid to highlight the ethylene vinyl alcohol and polyester elastomer. In the micrograph of FIG. 5, the mottled gray portions 32 are the polybutylene terepthalate (4GT polyester) and the polyester elastomer, the small light colored portions 31 are the polyolefins, the very small dark portions 34 are the nylon, and the light gray portions 33 are the epoxy that was added for sectioning. In the micrograph of FIG. 6, the light portions 36 are the 4GT polyester and polyolefin (with the light speckled portions 35 probably being primarily polyolefin), the dark specs 37 are the ethylene vinyl alcohol copolymer and the nylon, and the large light gray portions are the epoxy that was added for sectioning.

EXAMPLES

Test Apparatus for Examples 1–25 and Comparative Examples 1–10

A continuous rotary mixer, as described above, was used in the following non-limiting examples which are intended to illustrate the invention and not to limit the invention in any manner. The volume of the mixer's mixing chamber between the point where the polymer first contacts $CO_2$ plasticizing agent and the mixer outlet was 495 $cm^3$. The mixer was rated to withstand a working pressure of 41,000 kPa. The mixer was operated at a rotational rate of approximately 1200 rpm with power of between 7 and 10 kW. Polymer was injected into the mixer by a polymer screw extruder and gear pump. Supercritical $CO_2$ plasticizing agent from a pressurized storage tank and distilled water from a closed storage tank were both injected into the mixer by double acting piston pumps. A dispersion of polymer, supercritical $CO_2$ and water was generated by the mixer and was flash-spun through a spin orifice into a zone maintained at atmospheric pressure and room temperature. Unless stated otherwise, the spinning temperature was approximately 240° C. and the spinning pressure was approximately 28,900 kPa. The spin products were collected on a moving belt from which samples were removed for examination and testing.

Test Apparatus for Examples 26–34

The apparatus used in the Examples 26–34 is the spinning apparatus described in U.S. Pat. No. 5,147,586. The apparatus consists of two high pressure cylindrical chambers, each equipped with a piston which is adapted to apply pressure to the contents of the chamber. The cylinders have an inside diameter of 1.0 inch (2.54 cm) and each has an internal capacity of 50 cubic centimeters. The cylinders are connected to each other at one end through a 3/32 inch (0.23 cm) diameter channel and a mixing chamber containing a series of fine mesh screens that act as a static mixer. Mixing is accomplished by forcing the contents of the vessel back and forth between the two cylinders through the static mixer. A spinneret assembly with a quick-acting means for opening the orifice is attached to the channel through a tee. The spinneret assembly consists of a lead hole of 0.25 inch (0.63 cm) diameter and about 2.0 inch (5.08 cm) length, and a spinneret orifice with length and diameter of 30×30 mils (0.76×0.76 mm). The pistons are driven by high pressure water supplied by a hydraulic system.

In the tests reported in Examples 26–34, the apparatus described above was charged with pellets of a blend of polymers and a solvent. High pressure water was used to drive the pistons to generate a mixing pressure of between 1500 and 3000 psi (10,340–10,680 kPa). The polymer and solvent were next heated to mixing temperature and held at that temperature for about an hour during which time the pistons were used to alternately establish a differential pressure of about 50 psi (345 kPa) between the two cylinders so as to repeatedly force the polymer and solvent through the mixing channel from one cylinder to the other to provide mixing and effect formation of a spin mixture. The spin mixture temperature was then raised to the final spin temperature, and held there for about 15 minutes to equilibrate the temperature, during which time mixing was continued. In order to simulate a pressure letdown chamber, the pressure of the spin mixture was reduced to a desired spinning pressure just prior to spinning. This was accomplished by opening a valve between the spin cell and a much larger tank of high pressure water ("the accumulator") held at the desired spinning pressure. The spinneret orifice is opened about one to five seconds after the opening of the valve between the spin cell and the accumulator. This period roughly corresponds to the residence time in the letdown chamber of a commercial spinning apparatus. The resultant flash-spun product is collected in a stainless steel open mesh screen basket. The pressure recorded just before the spinneret using a computer during spinning is entered as the spin pressure.

Spin Product Test Procedures

Test data not originally obtained in the SI system of units has been converted to SI units.

The denier of the strand is determined from the weight of a 15 cm sample length of strand.

Tenacity, elongation and toughness of the flash-spun strand are determined with an Instron tensile-testing machine. The strands are conditioned and tested at 70° F. and 65% relative humidity. The strands are then twisted to 10 turns per inch and mounted in the jaws of the Instron Tester. A two-inch gauge length was used with an initial elongation rate of 4 inches per minute. The tenacity at break is recorded in grams per denier (gpd). The elongation at break is recorded as a percentage of the two-inch gauge length of the sample. Toughness is a measure of the work required to break the sample divided by the denier of the sample and is recorded in gpd. Modulus corresponds to the slope of the stress/strain curve and is expressed in units of gpd.

Fiber quality for Examples 1–25 and Comparative Examples 1–14 was evaluated using a subjective scale of 0 to 3, with a 3 being the highest quality rating. Under the evaluation procedure, a 10 inch length of a plexifilamentary strand is removed from a fiber batt. The web is spread and mounted on a dark background. The fiber quality rating is an average of three subjective ratings, one for fineness of the fiber (finer fibers receive higher ratings), one for the continuity of the fiber strand (continuous plexifilamentary strands receive a higher rating), and the other for the frequency of the ties (more networked plexifilamentary strands receive a higher rating).

Fiber fineness is measured using a technique similar to that disclosed in U.S. Pat. No. 5,371,810 to A. Ganesh Vaidyanathan dated Dec. 6, 1994, and which is hereby incorporated by reference. This technique quantitatively analyzes fibril size in webs of fiber. The webs are opened up by hand and imaged using a microscopic lens. The image is then digitized and computer analyzed to determine the mean fibril width and standard deviation. However, some smaller fibrils may be so tightly bunched together and have such short fibril length, that the fibrils appear as part of a large fibril and are counted as such. Tight fibril bunching and short fibril length (distance from tie point to tie point) can effectively prevent analysis of the fineness of individual fibrils in the bunched fibrils. Thus, the term "apparent fibril size" is used to describe or characterize fibers of plexifilamentary strands.

The surface area of the plexifilamentary film-fibril strand product is another measure of the degree and fineness of fibrillation of the flash-spun product. Surface area is measured by the BET nitrogen absorption method of S. Brunauer, P. H. Emmett and E. Teller, J. Am. Chem. Soc., V. 60 p 309–319 (1938) and is reported as $m^2/g$.

Ingredients

The following ingredients were used in the non-limiting examples that follow. The percentages stated in the examples are by weight unless otherwise indicated. Each ingredient has been assigned a code by which it is referred to in the examples.

One 4GT polyester used in the following examples was CRASTIN® 6131 obtained from DuPont of Wilmington, Del. CRASTIN® is a registered trademark of DuPont. CRASTIN® 6131 was formerly sold under the name RYNITE® 6131. CRASTIN® 6131 is a non-reinforced low molecular weight 4GT polyester. CRASTIN® 6131 has a melt flow rate of 42 g/10 min by standard techniques at a temperature of 250° C. with a 2.16 kg weight, and has a melting point of 225° C. ("4GT-6131")

Another 4GT polyester used in the following examples was CRASTIN® 6130 obtained from DuPont of Wilmington, Del. CRASTIN® 6130 is a non-reinforced 4GT polyester with a higher molecular weight than CRASTIN® 6131. CRASTIN® 6130 has a melt flow rate of 12.5 g/10 min by standard techniques at a temperature of 250° C. with a 2.16 kg weight, and has a melting point of 225° C. ("4GT-6130")

Another 4GT polyester used in the following examples was CRASTIN® 6129 obtained from DuPont of Wilmington, Del. CRASTIN® 6129 is a 4GT polyester with a molecular weight slightly higher than CRASTIN® 6130. CRASTIN® 6129 has a melt flow rate of 9 g/10 min by standard techniques at a temperature of 250° C. with a 2.16 kg weight, and has a melting point of 225° C. ("4GT-6129")

The polypropylene used in the following examples was Valtec HH444 obtained from Himont Corporation of Wilmington, Del. Valtec HH444 has a melt flow rate of 70 g/10 min by standard techniques at a temperature of 190° C. with a 2.16 kg weight, and has a melting point of 170° C. ("PP")

The polyester elastomer used in the following examples was HYTREL® 6133, a melt spinnable block copolymer obtained from E. I. du Pont de Nemours and Co. of Wilmington, Del. HYTREL® is a registered trademark of DuPont. HYTREL® is a polyether ester block copolymer with a melt flow rate of 5.0 g/10 min by standard techniques at a temperature of 190° C. with a 2.16 kg weight, and it has a melting point in the range of 170–190° C. ("PEL")

The 2GT polyester used in the following examples was NUPET® (densified pellet). NUPET® is a 100% recycled polyethylene terephthalate obtained from DuPont of Wilmington, Del. NUPET® is a registered trademark of DuPont. NUPET® has a viscosity of 230 pascal seconds at 280° C., and it has a melting point of 252° C. ("2GT")

The 2GT polyester used in Examples 26–29 is a high molecular weight poly(ethylene terepthalate) with an inherent viscosity of 1.0, which was prepared by solid phase polymerization of a commercial grade 2GT. ("2GT*")

The polyethylene used in the following examples was ALATHON® H6018, a high density polyethylene that was obtained from Occidental Chemical Corporation of Houston, Tex. and its successor in interest Lyondell Petrochemical Company of Houston, Tex. ALATHON® is currently a registered trademark of Lyondell Petrochemical Company. ALATHON® H6018 has a melt flow rate of 18 g/10 min by standard techniques at a temperature of 190° C. with a 2.16 Kg weight, and has a melting point of 130–135° C. ("PE")

The polyethylene used in Examples 26–34 was a high density polyethylene (HDPE) with a melt index of 0.75, a density of 0.957 g/cc, a number average molecular weight of 27,000 and a weight average molecular weight of 120,000. ("HDPE")

The partially neutralized ethylene vinyl alcohol copolymer used in the following examples was SELAR® OH BX240 obtained from E. I. du Pont de Nemours and Co. of Wilmington, Del. SELAR® is a registered trademark of DuPont. SELAR® OH BX240 is a melt-blended, pelletized polymer consisting of 90% SELAR® OH 4416 and 10% FUSABOND™ E MB-259D, both polymers being obtained from DuPont of Wilmington, Del. SELAR® OH 4416 is an ethylene vinyl alcohol copolymer having 44 mole % ethylene units, a melt flow rate of 16.0 g/10 min by standard techniques at a temperature of 210° C. with a 2.16 kg weight, and a melting point of 168° C. FUSABOND™ E MB-259D is a polyethylene grafted with 0.2–0.3% maleic anhydride, having a melt flow rate of 20–25 g/10 min by standard techniques at a temperature of 190° C. with a 2.16 kg weight, and a melting point of 120–122° C. FUSABOND™ is a trademark of DuPont. ("EVOH")

The ethylene and methacrylic acid copolymer used in the following examples was SURLYN® 1702, obtained from DuPont of Wilmington, Del. SURLYN® is a registered trademark of DuPont. SURLYN® 1702 has a melt flow rate of 14.0 g/10 min by standard techniques at a temperature of 190° C. with a 2.16 kg weight, and it has a melting point of 89° C. ("Surlyn")

The nylon 6 used in the following examples was CAPRON® 8202C obtained from Allied-Signal Inc. of Morristown, N.J. CAPRON® is a registered trademark of Allied-Signal Inc. CAPRON® 8202C is a low viscosity, high crystallinity nylon 6 commonly used for injection molding. CAPRON® 8202C has a specific gravity of 1.13 g/cc and a melting point of 215° C. ("Nylon")

The coextrudable ethylene vinyl acetate adhesive polymer used in the following examples was BYNEL® 3101, obtained from DuPont of Wilmington. Del. BYNEL® is a registered trademark of DuPont. BYNEL® 3101 has a melt flow rate of 3.5 g/10 min by standard techniques at a temperature of 190° C. with a 2.16 kg weight, and it has a melting point of 87° C. ("Bynel")

The ethylene methylacrylate used in Examples 29 and 32–34 is OPTIMA TC110, with a melt index of 2.0, a methyl acrylate content of 21.5 weight percent, a density of 0.942 g/cc, and a melting point of 75° C., obtained from Exxon Chemical Company. ("EMA")

The polybutylene naphthalate polyester polymer used in the following examples was a non-commercial product obtained from Teijin Limited of Tokyo, Japan. The polybutylene napthalate had an intrinsic viscosity of 0.76 and a melting point of 245 ° C. ("PBN")

The polyethylene napthalate polyester polymer used in the following examples was HiPERTUF™ 35000 obtained from Shell Chemical Company of Akron, Ohio. HiPERTUF™ is a trademark of Shell Chemical Company. HiPERTUF™ 35000 polyester resin is a 2,6 dimethyl napthalate based polyethylene napthalate resin. It is a low molecular weight polymer with a viscosity of approximately 350 pascal seconds at 295° C., and a melting point in the range of 266–270° C.

The polyglucosamine used in the following examples was Chitosan VNS-589 obtained from Vanson, L. P. of Redmond, Wash. Chitosan is a naturally occurring polymer made from crustacean shells. Chitosan has a chemical structure similar to cellulose except that one of the hydroxyl groups of the cellulose molecule is replaced by an amine group. ("Chitosan")

The flame retardant additive used in the following examples was ANTIBLAZE® 1045 flame retardant obtained from Albright and Wilson Americas of Richmond, Va. ANTIBLAZE® 1045 is a registered trademark of Albright & Wilson Americas. ANTIBLAZE® 1045 is a phosphorus-based product sold as a glass type liquid. ANTIBLAZE® 1045 has a density of 1.26 g/cc at 25° C. and a viscosity of 180 cp at 130° C. ("Fire Retardant")

The activated carbon additive used in the following examples was PCB-G Coconut-based activated carbon obtained from Calgon Carbon Corporation of Pittsburgh, Pa. PCB-G activated carbon is a powder, 90% of which passes through a 0.044 mesh screen. PCB-G activated carbon has a surface area of 1150 to 1250 $m^2/g$. ("Activated Carbon")

One color additive used in the following examples was LR-85548 BLUE LLDPE MB obtained form Ampacet Corporation of Terre Haute, Ind. LR-85548 BLUE LLDPE MB is a blue color concentrate encased inside a linear low density polyethylene shell, and is sold in pellet form. ("BLUE")

Another color additive used in the following examples was LD-90526 BLAZE ORANGE PE MB obtained form Ampacet Corporation of Terre Haute, Ind. LD-90526 BLAZE ORANGE PE MB is an orange color concentrate encased inside a linear low density polyethylene shell, and is sold in pellet form. ("ORANGE")

A heat stabilizer used in a number of the following examples was a disteary pentaerythritol diphosphite sold under the name Weston 619F by GE Specialty Chemicals. ("WESTON")

Example 1

The following polymer blends were sequentially injected into a continuous mixer and were mixed with $CO_2$ and water as described above. For each blend, the polymer/$CO_2$ ratio in the mixer was 1.25 and the polymer/water ratio in the mixer was 2.86. The test mixtures were each subsequently flash-spun from a 0.889 mm spinning orifice for approximately 15 minutes. The polymer ingredients and their ratios to each other were varied with each test. The ratios of total polymer to $CO_2$ and total polymer to water were held constant throughout the tests.

Ingredient ratios and product properties for the mixing phases are set forth in Table 1 below.

TABLE 1

| Test | 1 | 2 | 3 | 4 | 5 | 6 | 7 | 8 | 9 | 10 | 11 |
|---|---|---|---|---|---|---|---|---|---|---|---|
| 4GT-6131 | 100 | — | 34 | 32 | 34 | 34 | 32 | 24 | 24 | 40 | 34 |
| 4GT-6130 | — | 100 | 51 | 48 | 51 | 51 | 48 | 36 | 36 | 60 | 51 |
| PP | — | — | 15 | 15 | — | — | — | 9 | 9 | — | — |
| PEL | — | — | — | 5 | 15 | — | 5 | 13 | 13 | — | — |
| 2GT | — | — | — | — | — | — | — | — | — | — | 15 |
| PE | — | — | — | — | — | 15 | 15 | 18 | 17 | — | — |
| EVOH | — | — | — | — | — | — | — | — | 1 | — | — |
| Tenacity (gpd) | .8 | 1.25 | 1.85 | 2.05 | 1.3 | 1.70 | 1.65 | 1.45 | 1.85 | 1.25 | .95 |
| Fiber Quality | 1.5 | 1.3 | 2.0 | 2.3 | 1.5 | 2.0 | 2.0 | 1.8 | 2.3 | 1.3 | 1.3 |

Example 2

A melted blend of 30% 6 4GT-6131, 15% 4GT-6130, 13% PEL, 19% PE, 19% PP, 1% EVOH, and 3% Nylon 6 was injected into a continuous mixer and was mixed with $CO_2$ and water as described above. The polymer/$CO_2$ ratio in the mixer was 2.86 and the polymer/water ratio in the mixer was 1.25. The mixture was subsequently flash-spun from a 0.889 mm spinning orifice for approximately 15 minutes. A plexifilamentary fiber strand was obtained that had a tenacity of 2.2 gpd, an elongation of 0 61.5%, a toughness of 0.8 gpd, and a fiber quality rating of 2.25. The fibers had a median width of 13.3 microns, and a mean width of 36.0 microns with a standard deviation of 66.5 microns, and a surface area of 6.1 $m^2/g$.

Example 3

A melted blend of 60% 4GT-6131, 30% 4GT-6130, 9% PE, and 1% EVOH as injected into a continuous mixer and was mixed with $CO_2$ and water as described above. The polymer/$CO_2$ ratio in the mixer was 1.25 and the polymer/water ratio in the mixer-was 2.86. The mixture was subsequently flash-spun from a 0.889 mm spinning orifice for approximately 15 minutes. A plexifilamentary fiber strand was obtained that had a tenacity of 2.3 gpd, an elongation of 43%, a toughness of 0.6 gpd, and a fiber quality rating of 2.3.

Example 4

A melted blend of 18% 4GT-6131, 45% 4GT-6130, 12% PEL, 16% PE. 8% PP, and 1% EVOH was injected into a continuous mixer and was mixed with $CO_2$ and water as described above. The polymer/$CO_2$ ratio in the mixer was 1.25 and the polymer/water ratio in the mixer was 2.86. The mixture was subsequently flush-spun from a 0.889 mm spinning orifice for approximately 15 minutes. A plexifilamentary fiber strand was obtained that had a tenacity of 2.9 gpd, an elongation of 37%, a toughness of 0.6 gpd, and a fiber quality rating of 2.5. The fibers had a median width of 14.4 microns, a mean width of 35.7 microns with a standard deviation of 61.8 microns, and a surface area of 6.6 $m^2/g$.

Example 5

A melted blend of 18% 4GT-6131, 30% 4GT-6130, 15% 4GT-6129, 12% PEL, 16% PE, 8% PP, and 1% EVOH was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes. A plexifilamentary fiber strand was obtained that had a tenacity of 2.4 gpd, an elongation of 48%, a toughness of 0.7 gpd, and a fiber quality rating of 2.5.

Example 6

A melted blend of 63% 4GT-6130, 12% PEL, 16% PE, 8% PP, and 1% EVOH was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes. A plexifilamentary fiber strand was obtained that had a tenacity of 2.5 gpd, an elongation of 38%, a toughness of 0.6 gpd, and a fiber quality rating of 2.7. The fibers had a median width of 12.2 microns, a mean width of 32.3 microns with a standard deviation of 53.6 microns, and a surface area of 6.0 $m^2/g$.

Example 7

A melted blend of 51% 4GT-6131, 16% 4GT-6130, 10% PEL, 12% PE, 10% PP, and 1% EVOH was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.787 mm spinning orifice for approximately 15 minutes. A plexifilamentary fiber strand was obtained that had a tenacity of 2.8 gpd, an elongation of 62%, a toughness of 1.0 gpd, and a fiber quality rating of 2.2.

Example 8

A melted blend of 50% 4GT-6131, 35% 4GT-6130, 5% PEL, and 10% PP was injected into a continuous mixer and was mixed with $CO_2$ and water as described above. The polymer/$CO_2$ ratio in the mixer was 1.25 and ratio polymer-water ratio in the mixer was 2.86. The mixture was subsequently flash-spun from a 0.889 mm spinning orifice for approximately 15 minutes. A plexifilamentary fiber strand was obtained that had a tenacity of 2.6 gpd, an elongation of 37%, a toughness of 0.6 gpd, and a fiber quality rating of 2.5.

Example 9

A melted blend of 20% 4GT-6131, 15% 4GT-6130, 5% PEL, 10% PP and 50% 2GT was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes. A plexifilamentary fiber strand was obtained that had a tenacity of 1.3 gpd, an elongation of 54%, a toughness of 0.5 gpd, and a fiber quality rating of 1.8. The fibers had a median width of 14.36 microns, a mean width of 34.7 microns with a standard deviation of 50.8 microns. and a surface area of 5.1 $m^2/g$.

Example 10

A melted blend of 35% 4GT-6131, 15% 4GT-6130, 5% PEL, 10% PP, and 35% 2GT was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes. A plexifilamentary fiber strand was obtained that had a tenacity of 1.9 gpd, an elongation of 45%, a toughness of 0.45 gpd, and a fiber quality rating of 1.8. The sample had a mean apparent fibril size of 16.63 microns.

Example 11

A melted blend of 4% PEL, 82% PE, 9% PP, and 5% EVOH was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes at a spinning temperature of 200° C. A plexifilamentary fiber strand was obtained that had a tenacity of 0.8 gpd, an elongation of 89%, a toughness of 0.5 gpd, and a fiber fineness rating of 2.5.

Example 12

A melted blend of 5% PEL, 10% PP, and 85% Nylon 6 was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes. A plexifilamentary fiber strand was obtained that had a tenacity of 0.3 gpd, an elongation of 32%, a toughness of 0.7 gpd, and a fiber quality rating of 0.5.

Example 13

A melted blend of 10% EVOH, 88% PE, and 2% SURLYN was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes at a sinning temperature of approximately 200° C. A plexifilamentary fiber strand was obtained that had a tenacity of 1.3 gpd, an elongation of 50%. a toughness of 0.4 gpd, and a fiber quality rating of 2.2.

Example 14

A melted blend of 85.5% PE, 9.5% EVOH, and 5% BYNEL was injected into a continuous mixer and was mixed with $CO_2$ and water as described above. The polymer/$CO_2$ ratio in the mixer was 1.25 and the polymer/water ratio in the mixer was 1.79. The mixture was subsequently flash-spun from a 0.7874 mm spinning orifice for approximately 15 minutes. A plexifilamentary fiber strand was obtained that had a tenacity of 0.8 gpd and a fiber quality rating of 1.0.

Example 15

A melted blend of 50% 4GT-6131, 25% 3GT, and 25% PEL was injected into a continuous mixer and was mixed with $CO_2$ and water as described above. The polymer/$CO_2$ ratio in the mixer was 1.25 and the polymer water ratio in the mixer was 2.86. The mixture was subsequently flash-spun from a 0.787 mm spinning orifice for approximately 15 minutes. A plexifilamentary strand was obtained and had a tenacity of 1.04, an elongation of 58%, a toughness of 0.3 gpd, a surface area of 2.0 $m^2/g$ and a fiber quality rating of 2.3. The fibers had a median width of 12.2 microns, a mean width of 29.1 microns with a standard deviation of 42.2 microns, and a surface area of 2.0 $m^2/g$.

Example 16

A melted blend of 85% PBN, 5% PEL, 10% PP, was injected into a continuous mixer and was mixed with $CO_2$ and water as described above. The polymer/$CO_2$ ratio in the mixture was 1.25 and the polymer/water ratio in the mixer was 2.86. The mixture was subsequently flash-spun from a 0.889 mm spinning orifice for approximately 15 minutes. A plexifilamentary strand was obtained and had a tenacity of 2.5 gpd, an elongation of 23%, a toughness of0.3 gpd, and a fiber quality rating of 2.5.

Example 17

A melted blend of 16.2% 4GT-6131, 40.5% 4GT-6130, 10% PEN, 14.4% PE, 10.88% PEL, 7.2% PP, and 0.9% EVOH was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes. A plexifilamentary fiber strand was obtained and had a tenacity of 2.4 gpd, an elongation of 41%, a toughness of 0.6 gpd, and a fiber quality rating of 2.5.

Example 18

A melted blend of 90% 4GT-6131, 9% PE, and 1% EVOH was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.787 mm spinning orifice for approximately 15 minutes. A plexifilamentary fiber strand was obtained and had a tenacity of 1.6 gpd, a surface area of 17.6 $m^2$/gr., a toughness of 0.24. and a fiber quality rating of 2.7. A photo micrograph of a section of the strand magnified 54,600 times is shown in FIG. 1.

Example 19

Figure 7:
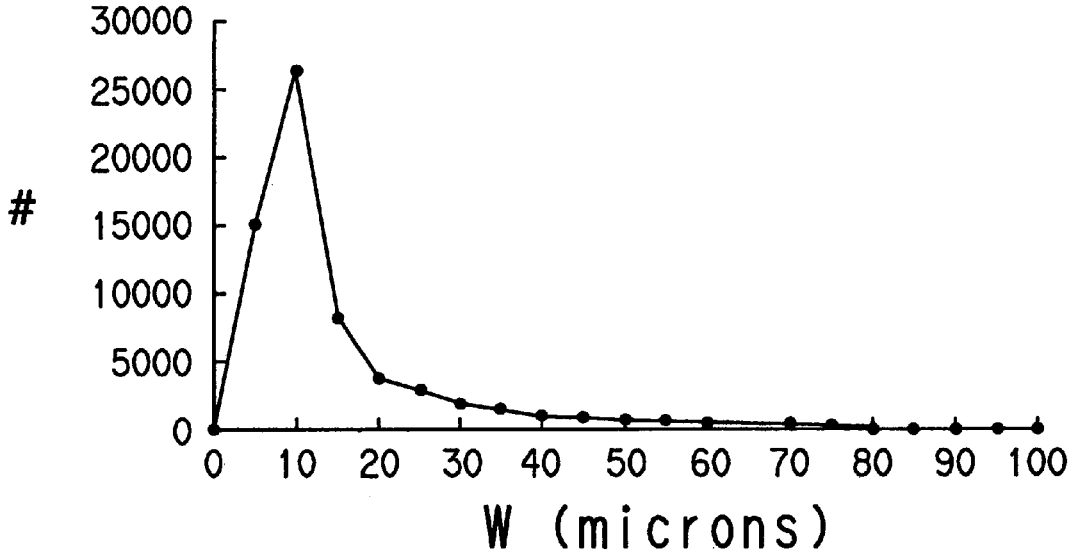
FIG. 7 is a histogram of apparent fiber widths measured on a sample of the plexifilamentary strand described in Example 19.

A melted blend of 45% 4GT-6131, 18% 4GT-6130, 16% PE. 12% PEL, 8% PP, and 1% EVOH was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.787 mm spinning orifice for approximately 15 minutes. A plexifilamentary fiber strand was obtained and had a tenacity of 2.2 gpd, a surface area of 8.5 $m^2$/gr., a toughness of 0.6, an apparent mean fiber size of 21.7 microns, and a fiber quality rating of 2.0. A histogram of the apparent fiber widths measured on this sample is shown in FIG. 7 with the fiber width in microns on the x-axis and the number of counts (#) on the y-axis.

Example 20

A melted blend of 16.18% 4GT-6131, 40.35% 4GT-6130, 9.96% 2GT, 14.34% PE, 10.76% PEL, 7.17% PP, 0.89% EVOH and 0.35% Chitosan was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes. A plexifilamentary fiber strand was obtained and it had a tenacity of 2.4 gpd, a toughness of 0.5, an elongation of 38%, and a fiber quality rating of 2.7.

Example 21

A melted blend of 29% 4GT-6131, 50% 2GT, 15% PEL, and 6% Fire Retardant was injected into a continuous mixer and was mixed with $CO_2$ and water as described above. The polymer/$CO_2$ ratio in the mixer was 1.25 and the polymer/water ratio in the mixer was 1.79. The mixture was subsequently flash-spun from a 0.889 mm spinning orifice for approximately 15 minutes. A plexifilamentary fiber strand was obtained, but the tenacity and toughness were too low to measure. The fiber quality rating was 1.3.

Example 22

A melted blend of 47.8% 4GT-6131, 33.4% 4GT-6130, 9.6% PP, 4.8% PEL, and 4.5% Activated Carbon was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes. A plexifilamentary fiber strand was obtained that had a tenacity of 1.4 gpd, an elongation of 26%, a toughness of 0.2 gpd, and a fiber quality rating of 2.0. The fibers had a median width of 15.43 microns, a mean width of 43.63 microns with a standard deviation of 79.5 microns, and a surface area of 12.9 $m^2/g$.

Example 23

A melted blend of 81.6% 4GT-6131, 9.6% PP, 4.8% PEL, and 4% BLUE pigment was injected into a continuous mixer and was mixed with $CO_2$ and water as described above. The polymer/$CO_2$ ratio in the mixer was 0.8 and the polymer/water ratio in the mixer was 0.35. The mixture was subsequently flash-spun from a 0.889 mm spinning orifice for approximately 15 minutes. A plexifilamentary fiber strand was obtained that had a tenacity of 2.1 gpd, an elongation of 53%, a toughness of 0.7 gpd, and a fiber quality rating of 2.0. The plexifilamentary fiber strand had a glossy deep ocean blue color.

Example 24

A melted blend of 81.6% 4GT-6131, 9.6% PP, 4.8% PEL, and 4% ORANGE pigment was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes. A plexifilamentary fiber strand was obtained that had a tenacity of 1.8 gpd, an elongation of 62%, a toughness of 0.6 gpd, and a fiber quality rating of 1.7. The plexifilamentary fiber strand had a uniform medium orange color.

Example 25

The following polymer blends were sequentially injected into a continuous mixer and were mixed with $CO_2$ and water as described above. For each blend, the polymer/$CO_2$ ratio in the mixer was 1.25 and the polymer/water ratio in the mixer was 2.86. The test mixtures were each subsequently flash-spun from a 0.889 mm spinning orifice for approximately 15 minutes. The polymer ingredients and their ratios to each other were varied with each test. The ratios of total polymer to $CO_2$ and total polymer to water were held constant throughout the tests.

Ingredient ratios and product properties for the mixing phases are set forth in Table 2 below.

TABLE 2

| Test | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 4GT-6131 | 100 | — | 40 | 34 | 32 | 34 | 32 | 34 | 32 | 34 | 24 | 24 | 24 | 24 | 24 | 24 |
| 4GT-6130 | — | 100 | 60 | 51 | 48 | 51 | 48 | 51 | 48 | 51 | 36 | 36 | 36 | 36 | 36 | 36 |
| PP | — | — | — | 15 | 15 | — | — | — | — | — | — | 15 | 9 | 9 | 10 | 8 |
| PEL | — | — | — | — | 5 | 15 | 5 | — | 5 | 15 | 15 | 15 | 13 | 13 | 10 | 11 |
| 2GT | — | — | — | — | — | — | — | 15 | — | — | 10 | 10 | — | — | 10 | 5 |
| PE | — | — | — | — | — | 15 | 15 | — | — | — | 15 | — | 18 | 17 | 10 | 15 |
| EVOH | — | — | — | — | — | | — | — | — | — | — | — | | 1 | — | 1 |
| Tenacity (gpd) | .86 | 1.3 | 1.45 | 2.75 | 2.35 | 2.05 | 2.25 | 1.1 | 1.65 | 2.3 | 1.85 | 2.45 | 2.15 | 2.25 | 2.3 | 2.4 |
| Fiber Quality | 1.15 | 1.3 | 1.7 | 2.5 | 2.3 | 2.2 | 2.7 | 1.3 | 2.0 | 2.7 | 2.5 | 2.8 | 2.7 | 2.2 | 2.3 | 2.5 |

Examples 26–34

In Examples 26–36, blends of three or more polymers were dissolved in a solvent and mixed under the conditions listed on the table below and the solution was flash-spun under the conditions listed on the table below. The solvents used were methylene chloride ($CH_2Cl_2$) and hydrofluorocarbon HFC-43-10 mee ($CF_3CHFCHFCF_2CF_3$). In each test WESTON heat stabilizer was included in the spin solution in an amount equal to 0.1% of the weight of the solvent. Plexifilamentary fibers were obtained in each case that had the properties listed on Table 3 below.

TABLE 3

| | Polymer | | Solvent | | | Mixing | | | Spinning | | Properties @ 10TP | | | | | |
|---|---|---|---|---|---|---|---|---|---|---|---|---|---|---|---|---|
| Ex No. | Name | P/P % | 1 | 2 | S1/S2 Wt % | ° C. | Min | Press MPa | Press MPa | ° C. | Den | Mod gpd | Ten gpd | E % | BET SA | Type |
| 26 | HDEP | 50 | | | | | | | | | | | | | | |
| | 2GT* | 25 | | HFC-43- | | | | | | | | | | | | |
| | PEL | 25 | CH2Cl2 | 10 mee | 99/1 | 210 | 60 | 17.3 | 7.7 | 212 | 476 | 1.8 | 1.4 | 80 | nm | plex |
| 27 | HDEP | 50 | | | | | | | | | | | | | | |
| | 2GT* | 35 | | HFC-43- | | | | | | | | | | | | |
| | PEL | 15 | CH2Cl2 | 10 mee | 99/1 | 210 | 60 | 17.3 | 8.0 | 209 | 465 | 2.1 | 1.3 | 84 | nm | plex |
| 28 | HDEP | 50 | | | | | | | | | | | | | | |
| | 2GT* | 45 | | HFC-43- | | | | | | | | | | | | |
| | PEL | 05 | CH2Cl2 | 10 mee | 99/1 | 210 | 60 | 17.3 | 8.7 | 214 | 421 | 2.4 | 1.3 | 84 | nm | plex |
| 29 | HDEP | 50 | | | | | | | | | | | | | | |
| | 2GT* | 30 | | | | | | | | | | | | | | |
| | PEL | 10 | | HFC-43- | | | | | | | | | | | | |
| | EMA | 10 | CH2Cl2 | 10 mee | 99/1 | 210 | 30 | 17.3 | 7.7 | 211 | 495 | 1.5 | 1.3 | 100 | nm | plex |
| 30 | HDEP | 50 | | | | | | | | | | | | | | |
| | 4GT-6130 | 35 | | HFC-43- | | | | | | | | | | | | |
| | PEL | 15 | CH2Cl2 | 10 mee | 99/1 | 210 | 30 | 17.3 | 8.4 | 211 | 443 | 1.5 | 1.5 | 88 | 7.7 | plex |
| 31 | HDEP | 50 | | | | | | | | | | | | | | |
| | 4GT-6130 | 45 | | HFC-43- | | | | | | | | | | | | |
| | PEL | 05 | CH2Cl2 | 10 mee | 99/1 | 210 | 30 | 17.3 | 8.2 | 206 | 412 | 2 | 1.6 | 102 | nm | plex |
| 32 | HDEP | 50 | | | | | | | | | | | | | | |
| | 4GT-6130 | 30 | | | | | | | | | | | | | | |
| | PEL | 10 | | HFC-43- | | | | | | | | | | | | |
| | EMA | 10 | CH2Cl2 | 10 mee | 99/1 | 210 | 30 | 17.3 | 7.9 | 208 | 463 | 1.2 | 1.3 | 100 | nm | plex |
| 33 | 4GT-6130 | 63 | | | | | | | | | | | | | | |
| | PEL | 12 | | | | | | | | | | | | | | |
| | HDEP | 24 | | | | 145– | | | | | | | | | | |
| | EMA | 01 | CH2Cl2 | NONE | 100/0 | 240 | | 18.0 | 11.1 | 240 | 181 | 2.2 | 1.7 | 92 | 6.5 | plex |
| 34 | 4GT-6130 | 80 | | | | | | | | | | | | | | |
| | PEL | 09 | | | | | | | | | | | | | | |
| | HDEP | 10 | | | | 145– | | | | | | | | | | |
| | EMA | 01 | CH2Cl2 | NONE | 100/0 | 240 | 22 | 18.0 | 11.1 | 241 | 222 | 1.3 | 1.1 | 108 | 6.1 | plex |

footnote: nm = not measured

Comparative Example 1

100% EVOH polymer melt was injected into a continuous mixer and was mixed with $CO_2$ and water as described above. The polymer/$CO_2$ ratio in the mixer was 1.0 and the polymer/water ratio in the mixer was 2.86. The mixture was subsequently flash-spun from a 0.787 mm spinning orifice for approximately 15 minutes. A plexifilamentary fiber strand was obtained that had a tenacity of 0.4 gpd, a toughness of 0.07 gpd, a surface area of 4.0 $m^2$/gr., and a fiber quality rating of 2.0.

Comparative Example 2

100% PE polymer melt was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun spun from a 0.787 mm spinning orifice for approximately 10 minutes. A plexifilamentary fiber strand was obtained that had a tenacity and a toughness that were too low to measure, and a fiber quality rating of 2.2.

Comparative Example 3

100% PP polymer melt was injected into a continuous mixer and was mixed with $CO_2$ and water as described above. The polymer/$CO_2$ ratio in the mixer was 2.14 and the polymer/water ratio in the mixer was 2.04. The mixture was subsequently flash-spun spun from a 0.787 mm spinning orifice for approximately 15 minutes. A plexifilamentary fiber strand was obtained that had a tenacity of 1.0 gpd, a toughness of 0.6, and a fiber quality rating of 1.2.

Comparative Example 4

100% 2GT polymer melt was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.787 mm spinning orifice for approximately 15 minutes. A plexifilamentary fiber strand was obtained that had a tenacity and a toughness that were too low to measure and a fiber quality rating of 0.7.

Comparative Example 5

100% Nylon 6,6 polymer melt was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.787 mm spinning orifice for approximately 15 minutes. A plexifilamentary fiber strand was obtained that had a tenacity and toughness that were too low to measure and a fiber fineness rating of 1.2.

Comparative Example 6

A melted blend of 90% PE and 10% EVOH was injected into a continuous mixer and was mixed with $CO_2$ and water as described above. The polymer/$CO_2$ ration in the mixer was 1.07 and the polymer/water ratio in the mixer was 2.38.

The mixture was subsequently flash-spun from a 0.787 mm spinning orifice for approximately 15 minutes. A plexifilamentary fiber strand was obtained that had a tenacity of 0.9 gpd, a toughness of 0.2 gpd, a surface area of 6.1 $m^2$/gr., and a fiber quality rating of 2.5. A photo micrograph of a section of the strand magnified 26,000 times is shown in FIG. 2.

Comparative Example 7

A melted blend of 4GT-6131 and PP was injected into a continuous mixer and was mixed with $CO_2$ and water as described above. The polymer/$CO_2$ ratio injected into the mixer was maintained at 1.25 and the polymer/water ratio injected into the mixer was maintained at 2.86. The mixture was subsequently flash-spun from a 0.889 mm diameter spinning orifice. During the test, the ratio of 4GT-6131 to PP was varied.

Ingredient ratios and product properties for the mixing phases are set forth in Table 4 below.

TABLE 4

| Test Phase | Duration (min) | Parts 4GT | Parts PP | Output Rate (kg/hr) | Tenacity (gpd) | Fiber Quality | Toughness (gpd) |
|---|---|---|---|---|---|---|---|
| 1 | 15 | 100 | 0 | — | 0.8 | 1.8 | 0.2 |
| 2 | 15 | 95 | 5 | 89.8 | 1.4 | 2.3 | 0.4 |
| 3 | 15 | 92 | 8 | 82.1 | 1.7 | 2.0 | 0.5 |
| 4 | 15 | 87 | 13 | 82.1 | 1.6 | 2.3 | 0.5 |
| 5 | 15 | 79 | 21 | 76.7 | 2.0 | 2.0 | 0.8 |
| 6 | 15 | 66 | 34 | 64.9 | 1.5 | 2.5 | 0.5 |
| 7 | 15 | 50 | 50 | 64.9 | 1.0 | 1.7 | 0.4 |

Comparative Example 8

A melted blend of 4GT-6131 and PEL was injected into a continuous mixer and was mixed with $CO_2$ and water as described above. The polymer/$CO_2$ ratio injected into mixer was maintained at 1.25 and the polymer/water ratio injected into the mixer was maintained at 2.86. The mixture was subsequently flash-spun from a 0.889 mm diameter spinning orifice. During the test, the ratio of 4GT-6131 to PEL was varied.

Ingredient ratios and product properties for the mixing phases are set forth in Table 5 below.

TABLE 5

| Test Phase | Duration (min) | Parts 4GT | Parts PEL | Output Rate (kg/hr) | Tenacity (gpd) | Quality | Toughness (gpd) |
|---|---|---|---|---|---|---|---|
| 1 | 15 | 100 | 0 | — | 0.8 | 1.8 | 0.2 |
| 2 | 15 | 95 | 5 | 93.0 | 0.9 | 2.0 | 0.2 |
| 3 | 15 | 92 | 8 | 86.2 | 0.7 | 1.7 | 0.2 |
| 4 | 15 | 87 | 13 | 87.5 | 0.8 | 1.5 | 0.2 |
| 5 | 15 | 79 | 21 | 93.0 | 0.9 | 1.7 | 0.2 |

Comparative Example 9

A melted blend of 4GT-6131 and 2GT was injected into a continuous mixer and was mixed with $CO_2$ and water as described above. The polymer/$CO_2$ ratio injected into the mixer was maintained at between 1.5 and 2.0 and the polymer/water ratio injected into the mixer was maintained at between 3.57 and 4.76. The mixture was subsequently flash-spun from a 0.889 mm diameter spinning orifice. During the test, the ratio of 4GT-6131 to 2GT was varied.

Ingredient ratios and product properties for the mixing phases are set forth in Table 6 below.

TABLE 6

| Test Phase | Duration (min) | Parts 4GT | Parts 2GT | Tenacity (gpd) | Quality | Toughness (gpd) |
|---|---|---|---|---|---|---|
| 1 | 15 | 100 | 0 | 0.5 | 1.5 | 0.14 |
| 2 | 15 | 95 | 5 | 0.76 | 1.5 | 0.2 |
| 3 | 15 | 85 | 15 | 0.79 | 1.5 | 0.2 |
| 4 | 15 | 70 | 30 | 0.43 | 1.5 | 0.1 |
| 5 | 15 | 50 | 50 | 0.28 | 1.0 | 0.1 |

Comparative Example 10

Figure 8:
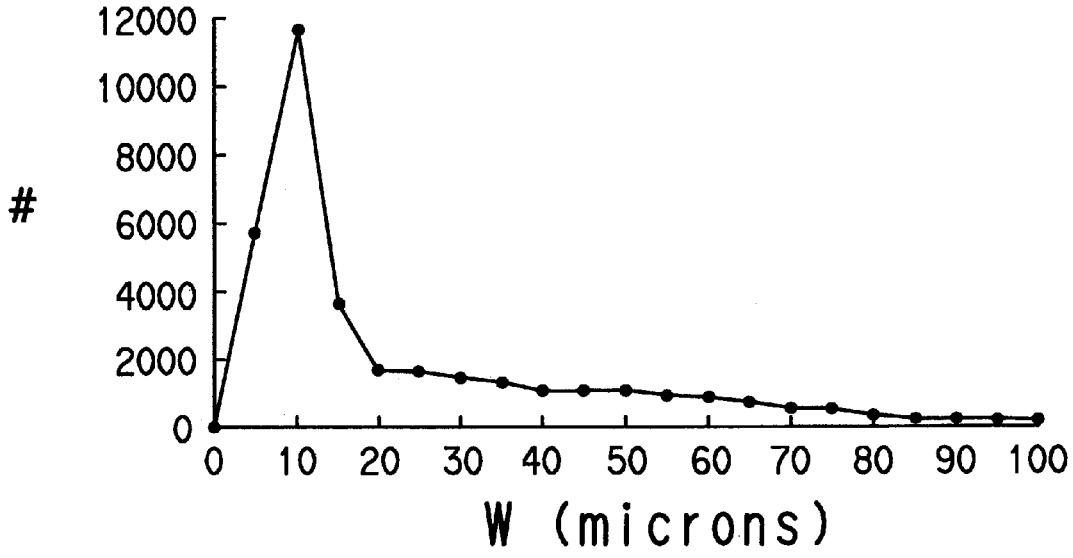
FIG. 8 is a histogram of apparent fiber widths measured on a sample of the plexifilamentary strand described in Comparative Example 10.

100% 4GT-6131 polymer melt was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes. A plexifilamentary fiber strand was obtained that had a tenacity of 0.8 gpd, a toughness of 0.2 gpd, an elongation of 54%, a mean apparent fiber size of 45.0, and a fiber quality rating of 1.5. A histogram of the apparent fiber widths measured on this sample is shown in FIG. 8 with the fiber width in microns on the x-axis and the number of counts (#) on the y-axis.

It will be apparent to those skilled in the art that modifications and variations can be made in the plexifilamentary strands of blended polymers of this invention. The invention in its broader aspects is, therefore, not limited to the specific details or the illustrative examples described above. Thus, it is intended that all matter contained in the foregoing description, drawings and examples shall be interpreted as illustrative and not in a limiting sense.

We claim:

1. A plexifilamentary strand material comprising a three dimensional integral plexus of fibrous elements substantially aligned with the strand axis, said fibrous elements each comprised of first, second and third synthetic, organic polymers, each of said polymers comprising between 1% and 98% by weight of said fibrous elements, wherein one of said polymers consists essentially of polyester.

2. The plexifilamentary strand material of claim 1 wherein said second and third polymers are each dispersed throughout said first polymer, each of said first, second and third polymers consisting essentially of a polymer that in its molten state is immiscible in the molten state of either of the other two of said polymers.

3. The plexifilamentary strand material of claim 2 wherein the second and third polymers are uniformly dispersed throughout said first polymer in the form of distinct immiscible phases.

4. The plexifilamentary strand material of claim 3 wherein said polyester is polyethylene terephthalate.

5. The plexifilamentary strand material of claim 3 wherein said polyester is polybutylene terephthalate.

6. The plexifilamentary strand material of claim 3 wherein the second and third polymers are each selected from the group of polyethylene polymers and copolymers, polypropylene polymers and copolymers, grafted and ungrafted copolymers of ethylene and vinyl alcohol, copolymers of methacrylic acid, polyester elastomer copolymers, nylon polymers and copolymers, and polyester polymers and copolymers.

7. The plexifilamentary strand material of claim 6 wherein polyester comprises between 30% and 90% by weight of said fibrous elements.

8. The plexifilamentary strand material of claim 6 wherein polyethylene comprises between 30% and 90% by weight of said fibrous elements.

9. The plexifilamentary strand material of claim 8 wherein each fibrous element further comprises a fifth synthetic, organic polymer discretely and uniformly dispersed throughout said first polymer, said fifth polymer consisting essentially of a polymer that in its molten state is immiscible in the molten state of said first, second, third and fourth polymers, said fifth polymer comprising between 1% and 50% by weight of said fibrous elements, said fifth polymer being selected from the group of polyethylene polymers and copolymers, polypropylene polymers and copolymers, grafted and ungrafted copolymers of ethylene and vinyl alcohol, copolymers of methacrylic acid, polyester elastomer copolymers, nylon polymers and copolymers, and polyester polymers and copolymers.

10. The plexifilamentary strand material of claim 9 wherein said polyester is polybutylene terepthalate and said fibrous elements are comprised of 40% to 80% by weight of polybutylene terephthalate, 5% to 20% by weight of polyester elastomer copolymer, 5% to 30% by weight of high density polyethylene, 5% to 20% by weight of polypropylene, and 1% to 5% by weight of ethylene vinyl alcohol copolymer.

11. The plexifilamentary strand material of claims 7 or 8 wherein said strand material has a surface area of at least 2.0 $m^2/g$ and has a tenacity of at least 2.0 gpd.

12. A plexifilamentary fiber strand material comprising a three dimensional integral plexus of fibrous elements substantially aligned with the strand axis, said fibrous elements each comprised of first, second and third synthetic, organic polymers, each of said polymers comprising between 1% and 98% by weight of said fibrous elements, said second and third polymers each being uniformly dispersed throughout said first polymer, each of said first, second and third polymers consisting essentially of a polymer that in its molten state is immiscible in the molten state of either of the other two of said polymers, second and third polymers being uniformly dispersed throughout said first polymer in the form of distinct immiscible phases, wherein each fibrous element further comprises a fourth synthetic, organic polymer that is discretely and uniformly dispersed throughout said first polymer, said fourth polymer consisting essentially of a polymer that in its molten state is immiscible in the molten state of said first, second and third polymers, said fourth polymer comprising between 1% and 50% by weight of said fibrous elements, said fourth polymer being selected from the group of polyethylene polymers and copolymers, polypropylene polymers and copolymers, grafted and ungrafted copolymers of ethylene and vinyl alcohol, copolymers of methacrylic acid, polyester elastomer copolymers, nylon polymers and copolymers, and polyester polymers and copolymers.

13. A plexifilamentary strand material comprising a three dimensional integral plexus of fibrous elements substantially aligned with the strand axis, said fibrous elements each comprised of first, second, and third synthetic, organic polymers, each of said polymers comprising between 1% and 98% by weight of said fibrous elements, and further comprising a fourth polymer comprising between 1% and 50% by weight of said fibrous elements.

* * * * *